United States Patent [19]

Naka et al.

[11] Patent Number: 5,025,891

[45] Date of Patent: Jun. 25, 1991

[54] ESCAPE FOR A BUILDING

[75] Inventors: Hiromitsu Naka; Yutaka Asai, both of Saitama; Shouzi Naka, Tokyo, all of Japan

[73] Assignee: Naka Technical Laboratory, Tokyo, Japan

[21] Appl. No.: 468,863

[22] Filed: Jan. 23, 1990

[51] Int. Cl.[5] ..... E06C 9/10

[52] U.S. Cl. ..... 182/86; 182/88

[58] Field of Search ..... 182/84, 85, 83, 88, 182/106, 86

[56] References Cited

U.S. PATENT DOCUMENTS

| | | | |
|---|---|---|---|
| 292,767 | 1/1884 | Stevenson | 182/84 |
| 500,030 | 6/1893 | Niehaus | 182/84 |
| 2,709,030 | 5/1955 | Vroman | 182/84 |
| 3,856,110 | 12/1974 | Nilsson | 182/84 |
| 4,079,812 | 3/1978 | Naka | 182/84 |
| 4,240,521 | 12/1980 | Naka | 182/84 |

*Primary Examiner*—Reinaldo P. Machado
*Attorney, Agent, or Firm*—Wenderoth, Lind & Ponack

[57] ABSTRACT

The escape of the present invention is installed in each storey of a building and comprises a storage space for the escape, a sliding platform, and an escape passageway. The storage space is formed in each storey of the building to have a configuration of a rectangular parallelepiped. The storage space has an opening in an external wall of a building. The platform is normally put away in the storage space and, in case of emergency, slides out from the opening of the storage space to form a landing of the escape passageway. The escape passageway is put up in the platform while one end of the passageway is pivotally attached to the platform to rotate the passageway downwards. When the escape is used, one end of the escape passageway rotates toward a lower platform to form an inclined passage between the upper and lower platforms.

6 Claims, 6 Drawing Sheets

ESCAPE FOR A BUILDING

BACKGROUND OF THE INVENTION

1. Field of the Invention

The present invention is directed to the field of an escape for a building, more particularly, relates to an escape installed in a building to let a person escape to a place of safety when a fire or an earthquake is occurred.

2. Description of the Prior Art

A building is provided with an escape in order to let a person escape from the inside of the building to a place of safety when a fire or an earthquake is occurred. The escape must be constructed to facilitate a person's escaping from a dangerous place in case of emergency. Therefore, as a general rule, the escape of the building must have a construction that a people can escape from any storeys of the building rapidly and safely. Furthermore, the escape is usually installed in an isolated space, such as in a fire zone or on an external wall of the building, in order to eliminate the influence of flame or smoke.

An emergency staircase is broadly used as an escape installed in the inside of a building. However, the emergency staircase is installed in a vertical hole formed in the building and therefore, the installation of an emergency staircase means to form a chimney-like hole in the building. Thereby, in case that flame of smoke flows into the chimney-like hole, it would be difficult for a person to pass the emergency staircase in the hole.

In order to avoid the influence of smoke of a fire, it is a usual manner to install an emergency staircase on an external wall of a building as shown in FIG. 12. In the figure, an emergency staircase 93 having a platform 91 and a stairs 92 is attached to an external wall 2 of a building 1 and so, in emergency, a people can escape from the building 1 through an emergency door 20 and the staircase 93.

However, an emergency staircase occupies a space in the inside or outside of a building though an emergency staircase will be used scarcely. That is to say, it would be desirable to eliminate the space occupied by the emergency staircase in a building.

SUMMARY OF THE INVENTION

The present invention consists of a plurality of platforms attached to a building in such a manner that each of the platforms is put away in the building when the escape is not used, and that each of the platforms projects in the outside of the building and extends in the horizontal direction when the escape is used; and an escape passageway attached to each of the platforms in such a manner that the escape passageway is put away in the platform when the escape is not used, and that one end of the passageway is lowered toward the lower platform so that the passageway forms an inclined passage between the upper and lower platforms when the escape is used.

Therefore, it is a principal object of the present invention to eliminate the space occupied by a traditional emergency staircase in a building.

It is other object of the present invention to provide an escape which is constructed to be put away in a building when the escape is not used and, in case of emergency, to project from the building to connect an upper and lower storeys to each other in the outside of the building.

It is further object of the present invention to provide an escape which is constructed to be put away in a building when the escape is not used and, in emergency, to form an automatically transferring passageway which connects an upper and lower storeys in the outside of the building.

Other objects and features of the present invention will be pointed out in the following description and claims and illustrated in the accompanying drawings, which disclose, by way of example, the principles of the present invention and the best mode which has been presently contemplated for carrying them out.

BRIEF DESCRIPTION OF THE DRAWINGS

In the drawings, in which similar elements are given similar reference numerals.

DESCRIPTION OF THE PREFERRED EMBODIMENTS

Figure 2:
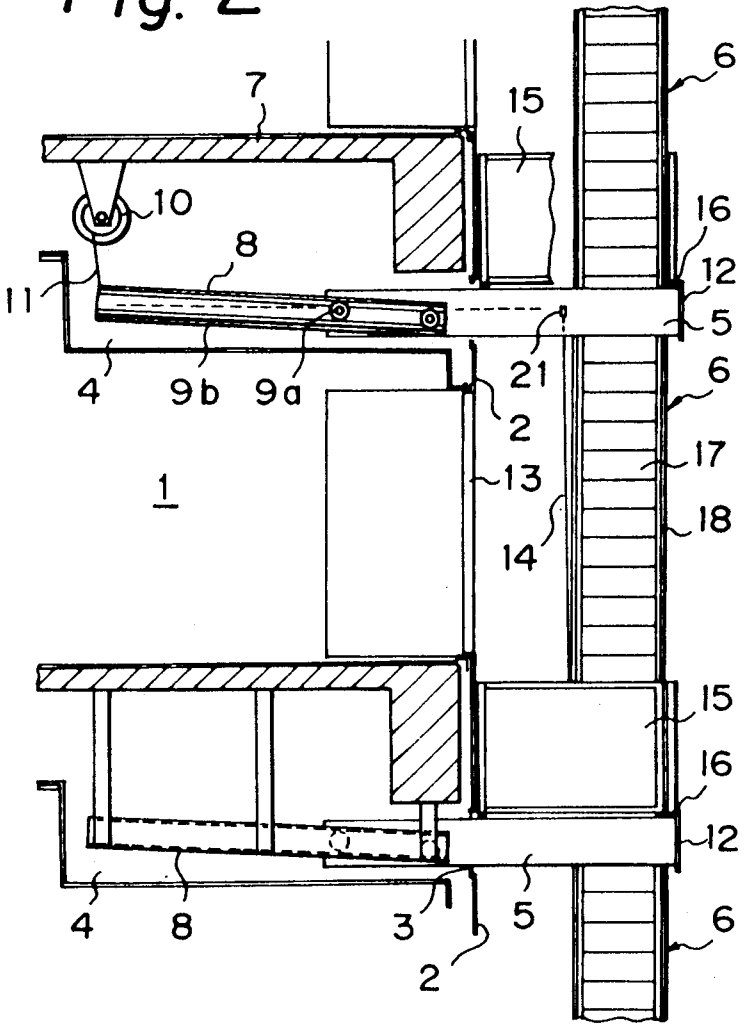
FIG. 2 is a vertical section of the escape of FIG. 1.

The first embodiment of the present invention is illustrated in FIGS. 1 to 4. As shown in these figures, the escape is installed in each story of a building 1 and comprises a storage space 4 for the escape, a sliding platform 5, and an escape passageway 6. The storage space 4 is formed in each storey of the building 1 to have a configuration of a rectangular parallelepiped. The storage space has an opening 3 on an external wall 2 of the building 1. The platform 5 is normally put away in the storage space 4 and, in emergency, slides out from the opening 3 to form a landing of the escape passageway 6. The escape passageway 6 is put up in the platform 5 while one end of the passageway 6 is pivotally attached to the platform 5. Thereby, the escape passageway 6 rotates downward from the platform 5 when the escape is used.

Figure 3:
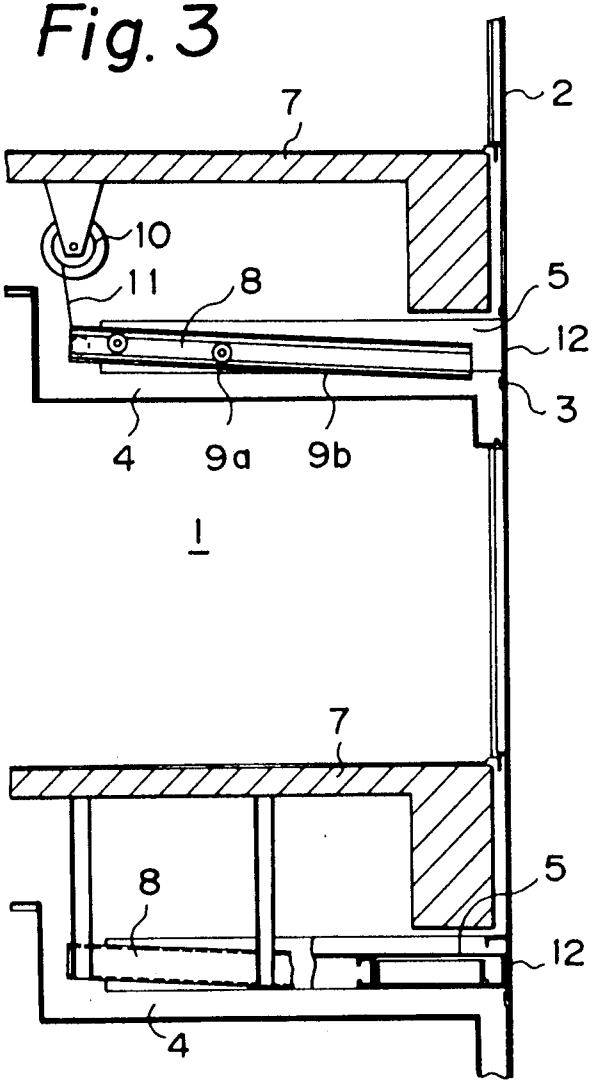
FIG. 3 is a vertical section of the escape of FIG. 1, but is in a position retracted in a building.

As shown in FIGS. 2 and 3, a supporting frame 8 is disposed in the storage space 4 to support the platform 5 substantially in horizontal. The supporting frame 8 is fixed to a proximal end of a beam 7 of the building 1.

The platform 5 has a plurality of rollers **9*a* which engage with carriage rails 9*b* formed on the both sides of the supporting frame 8, so that the platform 8 can move along the carriage rails 9*b*** smoothly. The carriage rails 9*b* incline downwards as the carriage rails 9*b* get close to the opening 3 so as to facilitate movement of the platform 5. In addition, in order to improve movement of the platform 5, an activation device constituted by a compression spring (not shown) can be disposed between the supporting frame 8 and the platform 5. The activation device forces the platform 5 out to protrude from the storage space 4.

In the storage space 4, a winding drum 10 is rotatably attached to the beam 7 and a wire rope 11 is wound around the winding drum 10. The wire rope 11 is connected to the platform 5 to control a sliding speed of the platform 5. That is, the winding drum 10 generates a rolling friction which controls movement of the platform 5. Furthermore, the platform 5 can be pulled into the storage space 4 by rotating the drum 10 to wind the wire rope 11 around the drum 10. An operator can control the winding drum 10 in the building 1. In other words, the winding drum 10 works as a speed controller of the platform 5 in case of emergency and works as a replacing device to draw the platform 5 in the storage space 4.

The sliding platform 5 has a blocking plate 12 at the front end thereof to close the opening 3 when the platform 5 is put away in the storage space 4. The outer surface of the blocking plate 12 is in the same plane as the external wall 2 of the building 1 when the platform 5 is fully retracted in the storage space 4. A sealing member (not shown) is attached to the inner periphery of the opening 3 and the outer periphery of the blocking plate 12 so that the sealing member can prevent rainwater from flowing into the storage space 4. However, the sealing member must be constructed so as not to obstruct the sliding movement of the platform 5.

Figure 4:
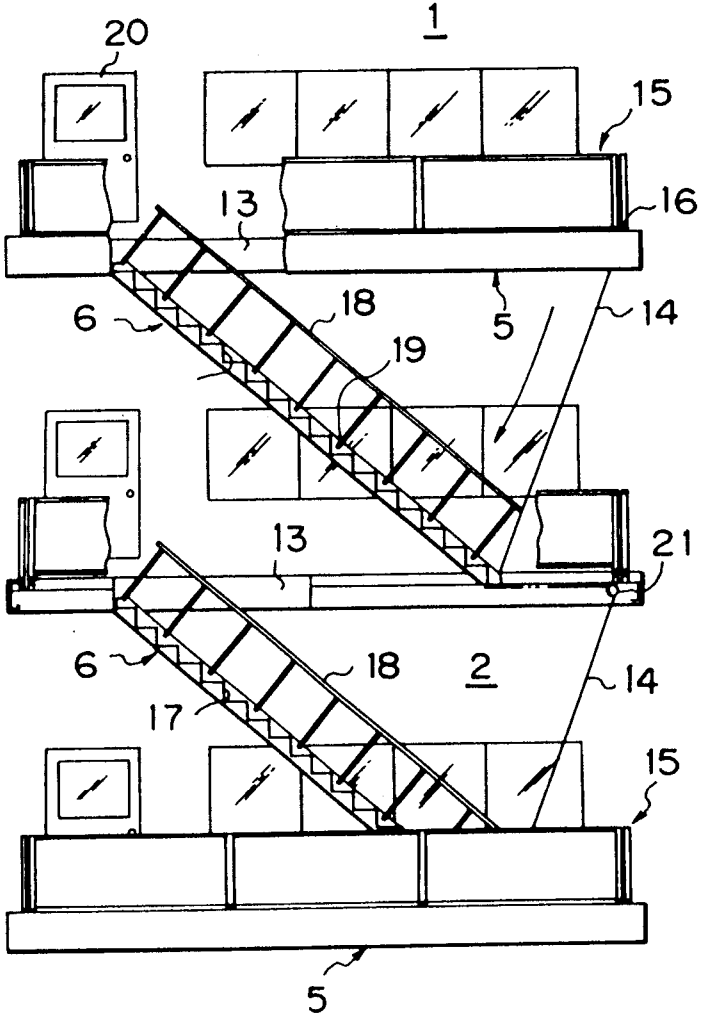
FIG. 4 is a fragmentary side view of the escape of FIG. 1.

In this embodiment, the escape passageway 6 is constituted by a stairway. As shown in FIG. 4, the escape stairway 6 is attached to the platform 5 in such a manner that one end of the stairway 6 is pivotally attached to the platform 5 to be adjacent to an entrance opening 13. The entrance opening 13 is formed in the platform 5 to pass a person in emergency. The other end of the stairway 6 can rotate downwards to reach a platform 5 of a downstairs which has projected from the external wall 2 of the building 1 and extended in parallel to the upper platform 5. A rewinder 21 is attached to the platform 5 and a wire rope 14 is wound around the rewinder 21. One end of the wire rope 14 is connected to the other end of the escape stairway 6 so that the rewinder 21 controls a descent speed of the stairway 6 to make a soft landing of the stairway 6 on the platform 5 of a downstairs. The escape stairways 6 start to descend after all the platforms 5 installed in the building 1 have fully slid out from the openings 3. As the descent of the escape stairway 6 has been completed, the stairway 6 extends between the upper and lower platforms 5, 5 to form an inclined passage for escape. A reference numeral 15 denotes a folding fence which is unfolded to form a fence on the periphery of the upper surface of the platform 5 when the platform 5 is in the position of FIG. 4.

The proximal ends of the folding fence 15 are pivotally attached to the sliding platform 5 by a pivot joint 19 so that the fence 15 is folded over the platform 5 when the platform 5 is in the storage space 4 and is automatically unfolded when the platform 5 projects from the building 1.

Figure 1:
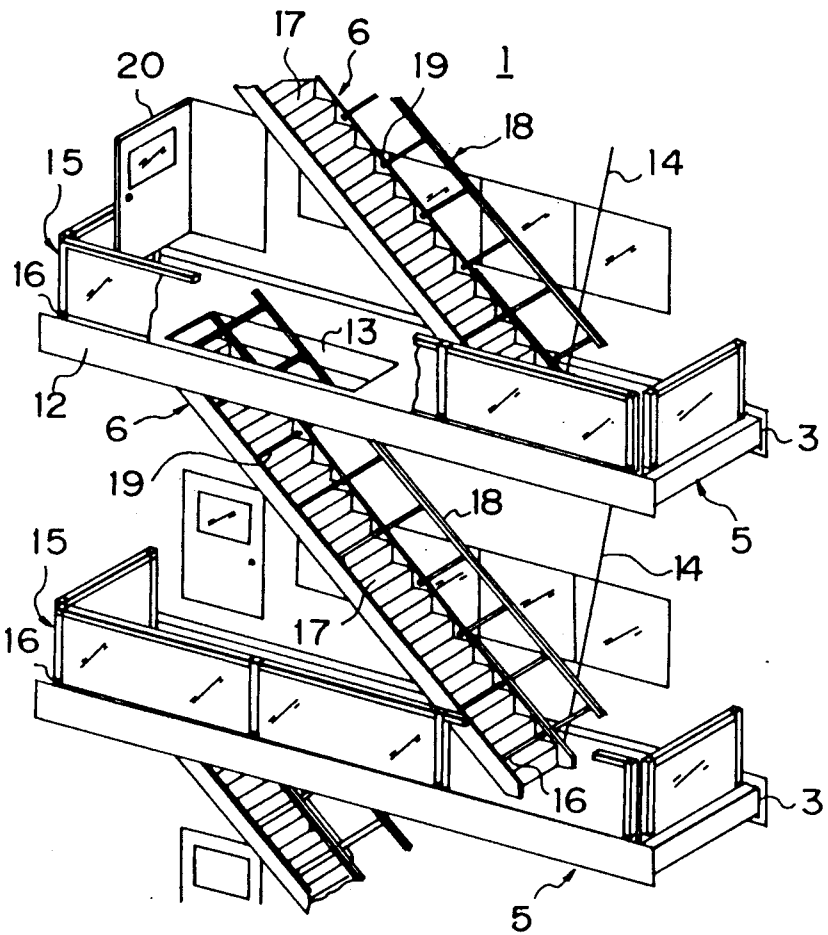
FIG. 1 is a perspective view of an escape formed in the outside of a building, which is shown as a first embodiment of the present invention.

As shown in FIGS. 1 and 4, the escape stairway 6 has a handrail 18 on one side of a stair tread 17 of the stairway 6. The proximal ends of the handrail 18 are pivotally attached to the stair tread 17 by a pivot joint 16 so that the handrail 18 can be folded over the stair tread 17 when the stairway 6 is put up in the platform 5. The handrail 18 is automatically unfolded to stand on one side of the stair tread 17 when a descent of the stairway 6 was completed.

The above-mentioned folding fence 15 and folding handrail 18 are used to save a space in the storage space 4 and therefore, in the other embodiment of the fence 15 and handrail 18, they may be constructed to be telescopic instead of folding.

When the building 1 is, for example, caught in a fire, an operator switches on a control unit (not shown) in the building 1. Thereby, all the sliding platforms 5 installed in the building 1 start to slide out from the corresponding openings 3 simultaneously, so that the platforms 5 project in the outside of the building 1 to be parallel to each other. At the same time, all the emergency doors 20 are unlocked. The emergency door 20 is arranged in each storey of the building 1 as shown in FIGS. 1 and 4.

As all the platforms 5 have been fixed in a position where the platforms 5 are fully projected from the building 1, each of the rewinders 21 releases the corresponding wire rope 14 to permit a downward rotation of the escape stairway 6 from the platform 5. The rewinder 21 controls a descent speed of the stairway 6 to make a soft landing of the stairway 6 onto the platform 5 of the downstairs. Then, as a descent of the platform 5 has been completed, the fence is unfolded to enclose the upper surface of the platform 5. At the same time, the handrail 18 is also unfolded to stand on one side of the stair tread 17 of the stairway 6. Therefore, a person can safely escape from the building 1 through the emergency door 20, the platform 5, and the escape stairway 6. The stairway 6 permit a person to escape either towards the upstairs or the downstairs of the building 1.

The descended stairway 6 can be put up in the platform 5 again by operating the rewinder 21 to wind the wire rope 14 thereon. However, by this time, the handrail 18 has to be already folded over the stair tread 17 of the stairway 6. Then, the sliding platform 5 is retracted in the storage space 4 by rolling the wire rope 11 onto the drum 10 after the fence 15 is folded over the platform 5.

The second embodiment of the present invention is illustrated in FIGS. 5 to 9. As shown in these figures, the escape is installed in each story of a building 1 and comprises a storage space 4 for the escape, a sliding platform 5, and an escape passageway 6. The storage space 4 is formed in each storey of the building 1 to have a configuration of a rectangular parallelepiped. The storage space has an opening 3 on an external wall 2 of the building 1. The platform 5 is normally put away in the storage space 4 and, in emergency, slides out from the opening 3 to form a landing of the escape passageway 6. The escape passageway 6 is put up in the platform 5 while one end of the stairway 6 is pivotally attached to the platform 5. Thereby, the escape passageway 6 rotates downward from the platform 5 when the escape is used.

Figure 6:
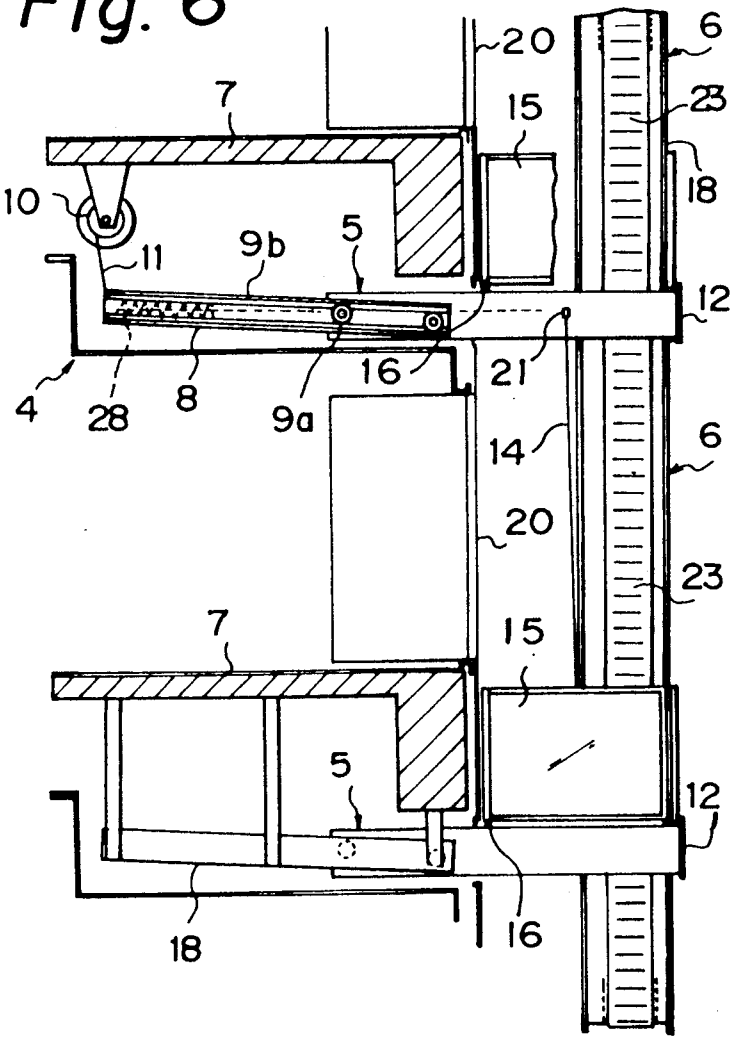
FIG. 6 is a vertical section view of the escape of FIG. 5.
Figure 7:
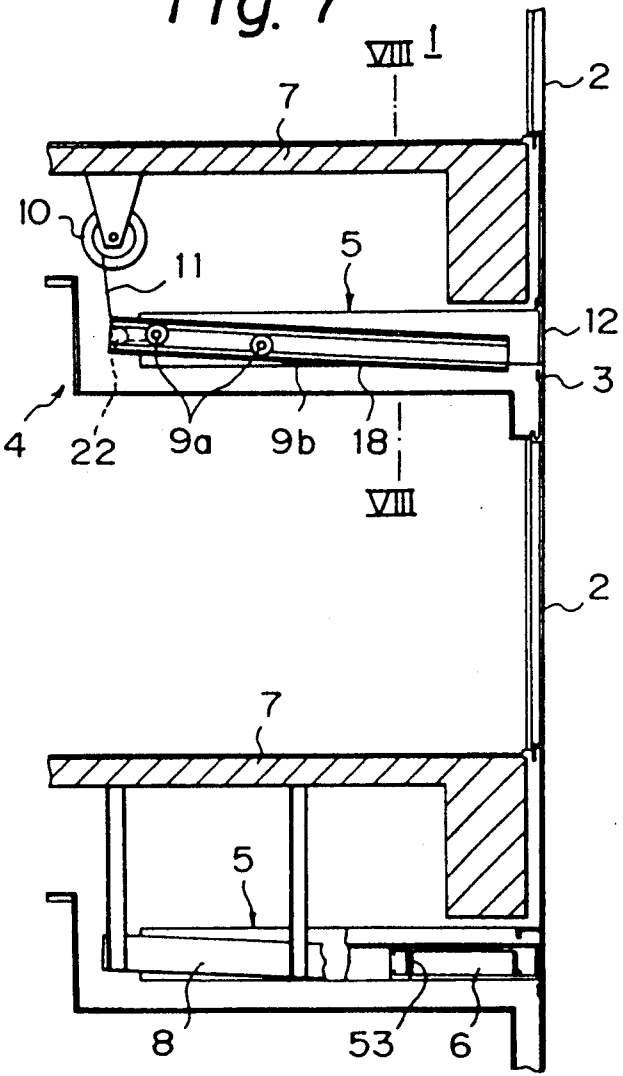
FIG. 7 is a vertical section view of the escape of FIG. 5, but is put away in the building.

As shown in FIGS. 6 and 7, a supporting frame 8 is disposed in the storage space 4 to support the platform 5 substantially in horizontal. The supporting frame 8 is fixed to a proximal end of a beam 7 of the building 1.

The platform 5 has a plurality of rollers 9*a* which engage with carriage rails 9*b* formed on the both sides of the supporting frame 8, so that the platform 8 can move along the carriage rails 9b smoothly. The carriage rails 9b incline downwards as the carriage rails 9b get close to the opening 3 so as to facilitate movement of the platform 5. In addition, in order to improve movement of the platform 5, an activation device constituted by a compression spring (not shown) can be disposed between the supporting frame 8 and the platform 5. The activation device forces the platform 5 out to protrude from the storage space 4.

In the storage space 4, a winding drum 10 is rotatably attached to the beam 7 and a wire rope 11 is wound around the winding drum 10. The wire rope 11 is connected to the platform 5 to control a sliding speed of the platform 5. That is, the winding drum 10 generates a rolling friction which controls movement of the platform 5. Furthermore, the platform 5 can be pulled into the storage space 4 by rotating the drum 10 to wind the wire rope 11 around the drum 10. An operator can control the winding drum 10 in the building 1. In other words, the winding drum 10 works as a speed controller of the platform 5 in case of emergency and works as a replacing device to draw the platform 5 in the storage space 4.

The sliding platform 5 has a blocking plate 12 at the front end thereof to close the opening 3 when the platform 5 is put away in the storage space 4. The outer surface of the blocking plate 12 is in the same plane as the external wall 2 of the building 1 when the platform 5 is fully retracted in the storage space 4. A sealing member (not shown) is attached to the inner periphery of the opening 3 and the outer periphery of the blocking plate 12 so that the sealing member can prevent rainwater from flowing into the storage space 4. However, the sealing member must be constructed so as not to obstruct the sliding movement of the platform 5.

Figure 9:
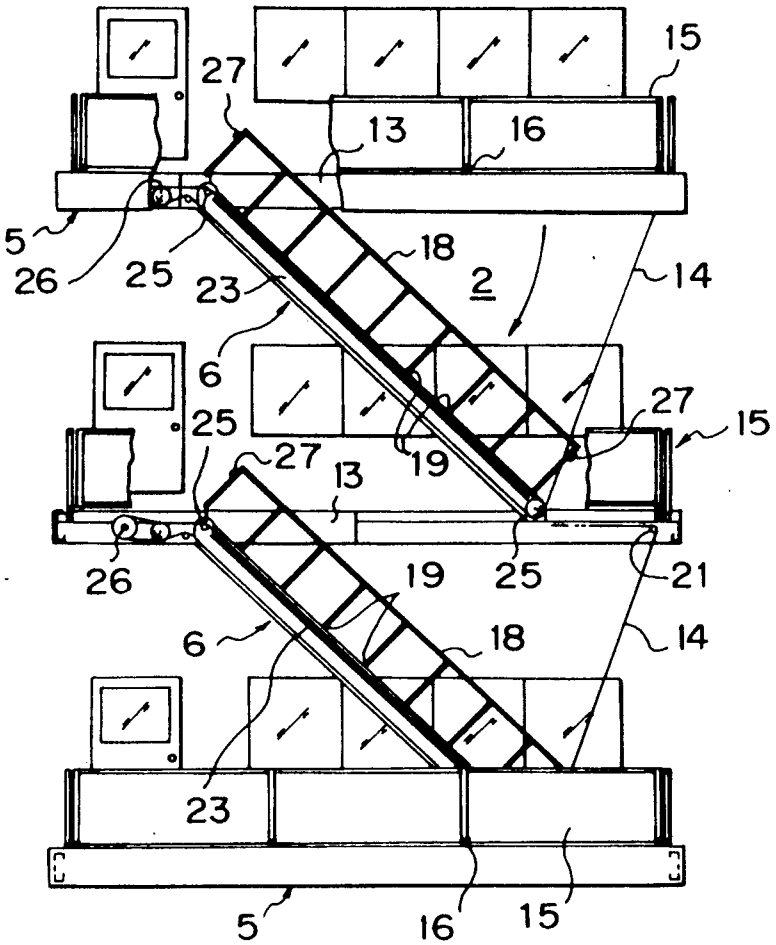
FIG. 9 is a fragmentary side view of the escape of FIG. 5.
Figure 12:
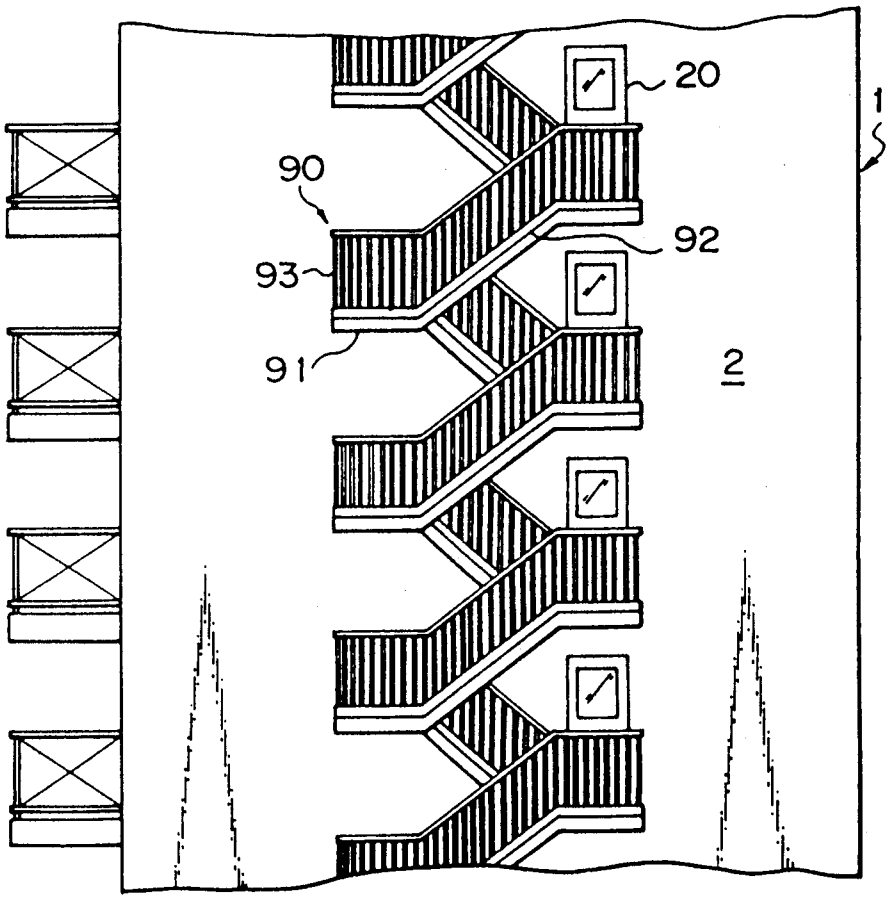
Fig. 12 (PRIOR ART)
FIG. 12 is a side view of a prior escape attached to an external wall of a building.

In this embodiment, the escape passageway 6 is constituted by a belt conveyor or a moving staircase. As shown in FIG. 9, the escape passageway 6 is attached to the platform 5 in such a manner that one end of the passageway 6 is pivotally attached to the platform 5 to be adjacent to an entrance opening 13. The entrance opening 13 is formed in the platform 5 to pass a person in emergency. The other end of the passageway 6 can rotate downwards to reach a platform 5 of the downstairs which has projected from the external wall 2 of the building 1 and extended in parallel to the upper platform 5. A rewinder 21 is attached to the platform 5 and a wire rope 14 is wound around the rewinder 21. One end of the wire rope 14 is connected to the other end of the escape passageway 6 so that the rewinder 21 controls a descent speed of the passageway 6 to make a soft landing of the passageway 6 on the platform 5 of a downstairs. The escape passageway 6 start to descend after all the platforms installed in the building 1 have fully slid out from the openings 3. As the descent of the escape stairway 6 has been completed, the passageway 6 extends between the upper and lower platforms 5, 5 to form an inclined passage for escape. A reference numeral 15 denotes a folding fence which is unfolded to form a fence on the periphery of the upper surface of the platform 5 when the platform 5 is in the position of FIG. 9.

The proximal ends of the folding fence 15 are pivotally attached to the sliding platform 5 by a pivot joint 19 so that the fence 15 is folded over the platform 5 when the platform 5 is in the storage space 4 and is automatically unfolded when the platform 5 projects from the building 1.

The escape passageway 6 has a transferring member 23 and a handrail member 18 on one side of the transferring member 23.

Figure 8:
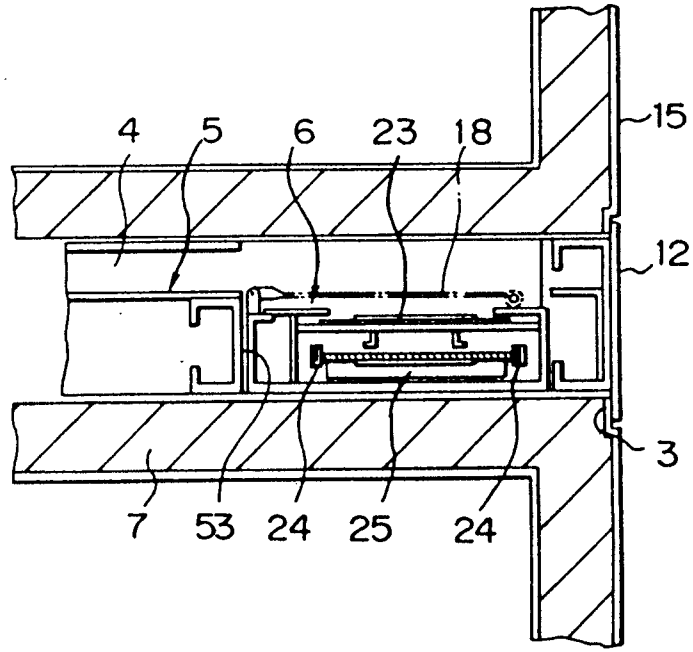
FIG. 8 is a section view taken along a line VIII—VIII in FIG. 7.

The transferring member 23 is an element of a belt conveyor or a moving staircase, which moves in the forward and backward directions. As shown in FIGS. 8 and 9, the transferring member 23 is rotatively supported by guide rollers 24 and return rollers 25 and is driven by an electric motor 26 installed in the sliding platform 5. The electric motor 26 is controlled by a switch 27 which is disposed in the both ends of the escape passageway 6.

The proximal ends of the handrail member 18 are pivotally attached to the escape passageway 6 by a pivot joint 16 so that the handrail member 18 is folded over the passageway 6 when the passageway 6 is put up in the platform 5. The handrail member 18 is automatically unfolded to stand on one side of the transferring member 23 when the descent of the passageway 6 was completed. Furthermore, a handle grip 18a is slidably attached on the handrail member 18. The handle grip 18a is also driven by the electric motor 26 to move in the same direction of the transferring member 23 and therefore, a person standing on the transferring member 23 gripes the handle grip 18a to hold him on the transferring member 23 steadily.

The above-mentioned folding fence 15 and folding handrail 18 are used to save a space in the storage space 4 and therefore, as a further embodiment of the fence 15 and handrail 18, they may be constructed to be telescopic instead of folding.

Figure 5:
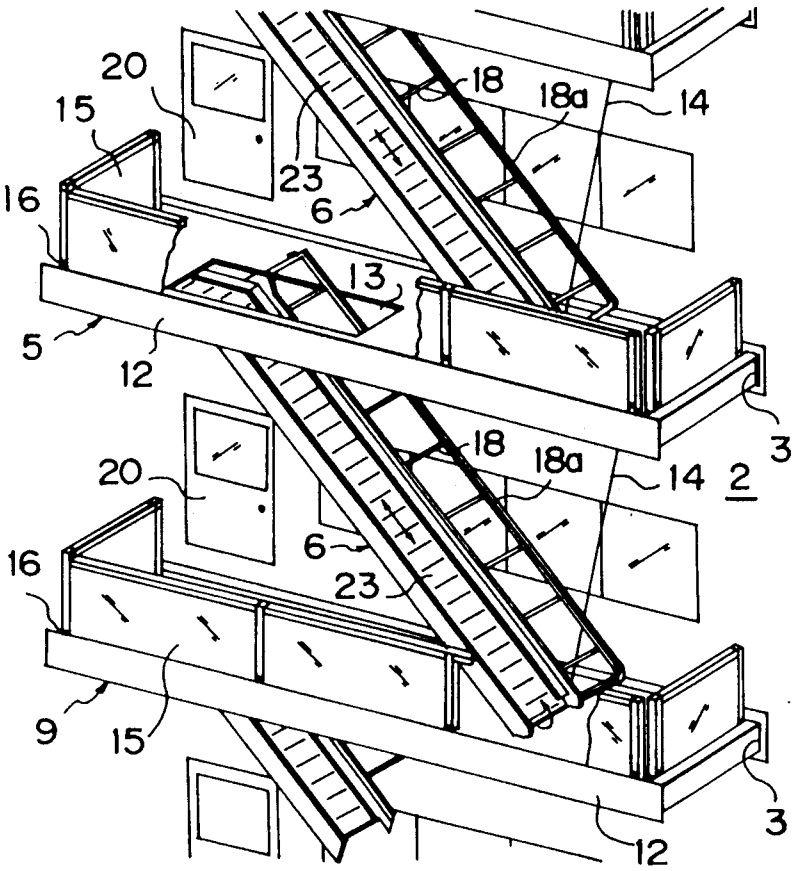
FIG. 5 is a perspective view of an escape formed in the outside of a building, which is shown as a second embodiment of the present invention.

When the building 1 is, for example, caught in a fire, an operator switches on a control unit (not shown) in the building 1. Thereby, all the sliding platforms 5 installed in the building 1 start to slide out from the corresponding openings 3 simultaneously, so that the platforms 5 project in the outside of the building 1 to be parallel to each other. At the same time, all the emergency doors 20 are unlocked. The emergency door 20 is arranged in each storey of the building 1 as shown in FIGS. 5 and 9.

As all the platforms 5 have been fixed in a position where the platforms 5 are fully projected from the building 1, each of the rewinders 21 releases the corresponding wire rope 14 to permit a downward rotation of the escape passageway 6 from the platform 5. The rewinder 21 controls a descent speed of the passageway 6 to make a soft landing of the passageway 6 onto the platform 5 of the downstairs. Then, as a descent of the passageway 6 has been completed, the fence 15 is unfolded to enclose the upper surface of the platform 5. At the same time, the handrail member 18 is also unfolded to stand on one side of the transferring member 23 of the passageway 6. Therefore, a person can safely escape from the building 1 through the emergency door 20, the platform 5, and the escape passageway 6. The passageway 6 permit a person to escape either towards the upstairs or downstairs of the building 1.

The descended passageway 6 can be put up in the platform 5 again by operating the rewinder 21 to roll the wire rope 14 thereon. However, by this time, the handrail 18 has to be already folded over the transferring member 23 of the passageway 6. Then, the sliding platform 5 is retracted in the storage space 4 by rolling the wire rope 11 onto the drum 10 after the fence 15 is folded over the platform 5.

Figure 10:
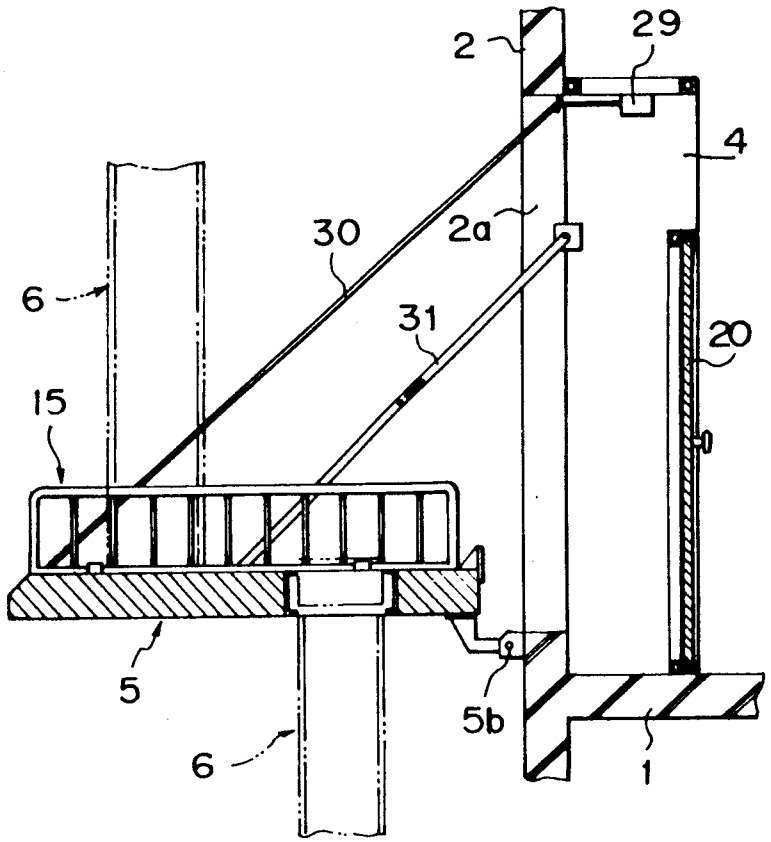
FIG. 10 is a vertical section of the escape, which is shown as a third embodiment of the present invention.

The third embodiment of the present invention is shown in FIG. 10. The escape of FIG. 10 is characterized by a rotative platform 5 which rotatively attached to the external wall 2 of the building 1 by a pivot shaft 5*b*. The platform 5 closes an opening 2*a* formed in the external wall 2 and, in case of emergency, the platform 5 rotates around a pivot shaft 5*b* in the counterclockwise direction in the figure to form a horizontal platform 5 in the outside of the building 1. In FIG. 10, a reference numeral 29 denotes a latching device; 30 denotes a wire rope; and 31 denotes a link. When the latching device 29 is released, the platform 5 rotates around the pivot shaft 5*b* to form the opening 2*a* in the external wall 2.

Figure 11:
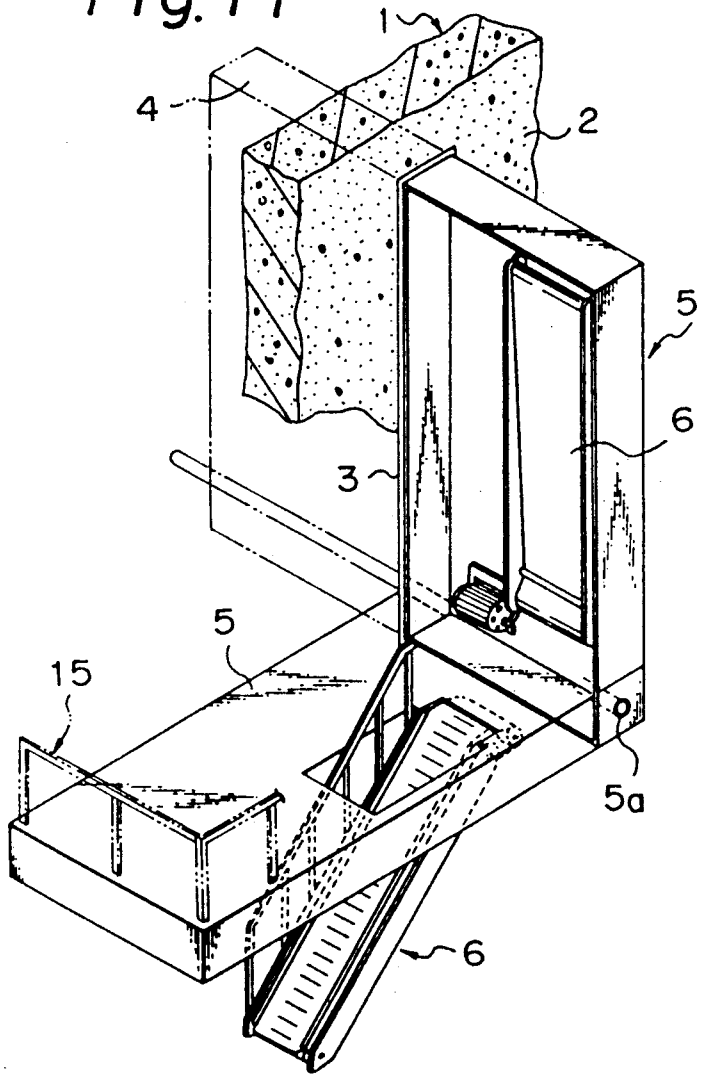
FIG. 11 is a vertical section of the escape, which is shown as a fourth embodiment of the present invention.

The fourth embodiment of the present invention is shown in FIG. 11. The escape of FIG. 11 is characterized by a platform 5 which is in an upright position when the platform 5 is put away in the storage space 4 of the building 1. The platform 5 is fixed to a supporting shaft 5 which can slide in the axial direction thereof and rotate around the axis thereof. In emergency, the platform 5 is pushed out from the storage space 4 by the supporting shaft 5*a* and then, is rotated by the supporting shaft 5*a* to form a horizontal platform 5 in the outside of the building 1.

In addition, it should be noted that the common numerals used to refer to the elements or members in the drawings of this application denote the same elements or members throughout all the figures in the drawings.

While there has been shown, described and pointed out the fundamental novel features of the present invention as applied to the preferred embodiments, it will be understand that various changes in the form and details of the devices illustrated in their operation may be made without departing from the spirit and scope of the invention.

What is claimed is:

1. An escape for a building, comprising:

a plurality of platforms spaced one above the other, a supporting shaft connected to one end of each of said platforms, the axis of said shaft extending in the horizontal direction, each said shaft being rotatably supported by said building and slidable in the axial direction, said building having a storage space for each platform to receive the corresponding platform in an upright position of the platform and into and out of which storage space the shaft for the corresponding platform is slidable, each said platform being slidable with the corresponding shaft out of said storage space to the outside of said building and turnable on said shaft to a horizontal position when said escape is to be used; and an escape passageway attached to each of said platforms in such a manner that said escape passageway is stored in the corresponding platform when said escape is not being used, and one end of said passageway is lowered toward the next lower platform in said plurality so that said passageway forms an inclined passage between vertically spaced platforms when said escape is to be used.

2. An escape as claimed in claim 1, in which said platform has a folding fence thereon, said fence being folded against said platform when said platform is stored in said building, and said fence being able to rise to enclose an upper surface of said platform when said platform projects to the outside of said building.

3. An escape as claimed in claim 1, in which said escape passageway comprises a stairway, one end of said stairway being rotatably attached to said platform and the other end of said stairway being connected to a rewinder through a wire rope, said passageway further having a folding handrail, and said stairway being rotatable toward a lower platform to form the inclined passageway when said escape is to be used.

4. An escape as claimed in claim 1, in which said escape passageway comprises a belt conveyor and an electric motor for driving said belt conveyor in the forward and backward direction, one end of said belt conveyor being rotatably attached to said platform and the other end of said belt conveyor being connected to a rewinder through a wire rope, said passageway further having a folding handrail, and said belt conveyor being rotatable toward a lower platform to form the inclined passageway when said escape is to be used.

5. An escape as claimed in claim 1, in which said escape passageway comprises a moving staircase and an electric motor for driving said moving staircase in the forward and backward direction, one end of said moving staircase being rotatably attached to said platform and the other end of said moving staircase being connected to a rewinder through a wire rope, said passageway further having a folding handrail, and said moving staircase being rotatable toward a lower platform to form the inclined passageway when said escape is to be used.

6. An escape for a building having a plurality of storeys, comprising:

a plurality of platforms spaced one above the other, said building having a plurality of storage spaces therein, one under a floor in each storey, for receiving said platforms therein for storage when said escape is not in use, each storage space having a plurality of carriage rails therein extending toward and inclined downwardly toward to opening of said storage space to the outside of the building, and each platform having a plurality of rollers thereon running on said rails for permitting each platform to roll down said rails to a horizontal projected position outside of the building when said escape is to be used; and an escape passageway attached to each of said platforms in such a manner that said escape passageway is stored in the corresponding platform when said escape is not being used, and one end of said passageway is lowered toward the next lower platform in said plurality so that said passageway forms an inclined passage between vertically spaced platforms when said escape is to be used.

* * * * *